US012601550B2

(12) United States Patent
Lin

(10) Patent No.: US 12,601,550 B2
(45) Date of Patent: Apr. 14, 2026

(54) GROOVED VAPOR CHAMBER CAPILLARY REFLOW STRUCTURE

(71) Applicant: TAIWAN MICROLOOPS CORP., New Taipei City (TW)

(72) Inventor: Chun-Hung Lin, New Taipei City (TW)

(73) Assignee: TAIWAN MICROLOOPS CORP., New Taipei City (TW)

( * ) Notice: Subject to any disclaimer, the term of this patent is extended or adjusted under 35 U.S.C. 154(b) by 110 days.

(21) Appl. No.: 18/599,207

(22) Filed: Mar. 8, 2024

(65) Prior Publication Data

US 2025/0244083 A1 Jul. 31, 2025

(30) Foreign Application Priority Data

Jan. 25, 2024 (TW) ..... 113103006

(51) Int. Cl.
*F28D 15/04* (2006.01)
*F28D 15/02* (2006.01)

(52) U.S. Cl.
CPC ..... *F28D 15/046* (2013.01); *F28D 15/0266* (2013.01)

(58) Field of Classification Search
CPC ..... F28D 15/04; F28D 15/046; F28D 15/0266
See application file for complete search history.

(56) References Cited

U.S. PATENT DOCUMENTS

2012/0145357 A1* 6/2012 Moon ..... F28D 15/0233 165/104.26
2014/0138056 A1* 5/2014 Horng ..... F28F 3/048 165/104.21
2016/0018165 A1* 1/2016 Ahamed ..... F28D 15/0233 165/104.26
2017/0227297 A1* 8/2017 Wang ..... B23P 15/26
(Continued)

FOREIGN PATENT DOCUMENTS

CN 202562344 U * 11/2012
CN 107764118 A * 3/2018 ..... F28D 15/04
(Continued)

OTHER PUBLICATIONS

English translation of TW 202344791 (Year: 2023).*
Office Action dated Aug. 12, 2024 of the corresponding Taiwan patent application No. 113103006.

*Primary Examiner* — Tho V Duong
(74) *Attorney, Agent, or Firm* — HDLS IPR SERVICES; Chun-Ming Shih

(57) ABSTRACT

A grooved vapor chamber capillary reflow structure includes a first plate, a second plate and a capillary structure. The first plate includes an inner surface, the second plate is sealed on the inner surface of the first plate, a chamber is formed between the second plate and the first plate, the capillary structure covers the inner surface of the first plate. The chamber contains at least one evaporation area and at least one condensation area, at least one reflow path is defined on the inner surface of the first plate, formed by a groove, and extends from one evaporation area to one condensation area (Continued)

in the chamber. In this way, the reflow path formed by the groove under the limited thickness space in the vapor chamber improves the condensation of the liquid state working fluid and facilitates quick reflow during heat exchange.

7 Claims, 6 Drawing Sheets

(56) References Cited

U.S. PATENT DOCUMENTS

| | | | | |
|---|---|---|---|---|
| 2018/0156545 | A1 | 6/2018 | Delano et al. | |
| 2019/0157746 | A1 * | 5/2019 | Ishizuka | H01Q 1/243 |

FOREIGN PATENT DOCUMENTS

| | | | | | |
|---|---|---|---|---|---|
| CN | 211953819 | U | | 11/2020 | |
| CN | 114341586 | A | * | 4/2022 | F28F 3/048 |
| TW | M562956 | U | | 7/2018 | |
| TW | 202344791 | A | | 11/2023 | |
| TW | M658585 | U | | 8/2024 | |

* cited by examiner

GROOVED VAPOR CHAMBER CAPILLARY REFLOW STRUCTURE

BACKGROUND OF THE DISCLOSURE

Technical Field

The present disclosure relates to a cooling device, and more particularly relates to a grooved vapor chamber capillary reflow structure.

Related Art

As the development of the computer industry grows rapidly, a larger amount of heat is generated by electronic heat-generating components or heat sources of a computer due to the increase in computation, performance or other factors, and the number of applications also increases due to the respective processing of the computer. For example, in addition to the motherboards and central processing units (CPUs) used to be the core components of the computer, graphics processing units (GPUs) and other electronic heat-generating components or heat sources are added in order to present a higher video quality.

However, heat dissipation devices such as vapor chambers are added to accelerate the working fluid to return from the vapor state to the liquid state and facilitate the reflow of the liquid-state working fluid, so a variety of different capillary structures are added. However, the vapor chamber is limited by the limited space of various electronic products, the continuous addition of different capillary structures will only increase the thickness of the vapor chamber and fail to realize the purpose of fast reflow in a thin space.

In view of this problem, the present discloser has focused on the above drawbacks of the related art to conduct extensive research and experiment and overcome the above-mentioned problem.

SUMMARY OF THE DISCLOSURE

The primary objective of the present disclosure is to provide a grooved vapor chamber capillary reflow structure that builds a path between an evaporation area and a condensation area in the vapor chamber for rapidly reflowing the working fluid in liquid state through the setup of a groove under the limited thickness of the space inside the vapor, so as to effectively enhance the reflow efficiency without increasing the thickness of the vapor chamber.

To achieve the aforementioned objective, the present disclosure provides a grooved vapor chamber capillary reflow structure, including a first plate, a second plate and a capillary structure. The first plate has an inner surface, the second plate is sealed on an inner surface of the first plate, a chamber is formed between the second plate and the first plate, and the capillary structure covers the inner surface of the first plate. The inside of the chamber includes at least one evaporation area and at least one condensation area, the inner surface of the first plate is provided with at least one reflow path formed by a groove and extending from an evaporation area to a condensation area in the chamber. In this way, the condensation of the liquid state working fluid is enhanced to facilitate the rapid reflow of the working liquid during heat exchange.

DETAILED DESCRIPTION

The technical characteristics of this disclosure will become apparent with the detailed description of preferred embodiments accompanied with the illustration of related drawings as follows. It is noteworthy that the embodiments and drawings disclosed herein are to be considered illustrative rather than restrictive.

Figure 1:
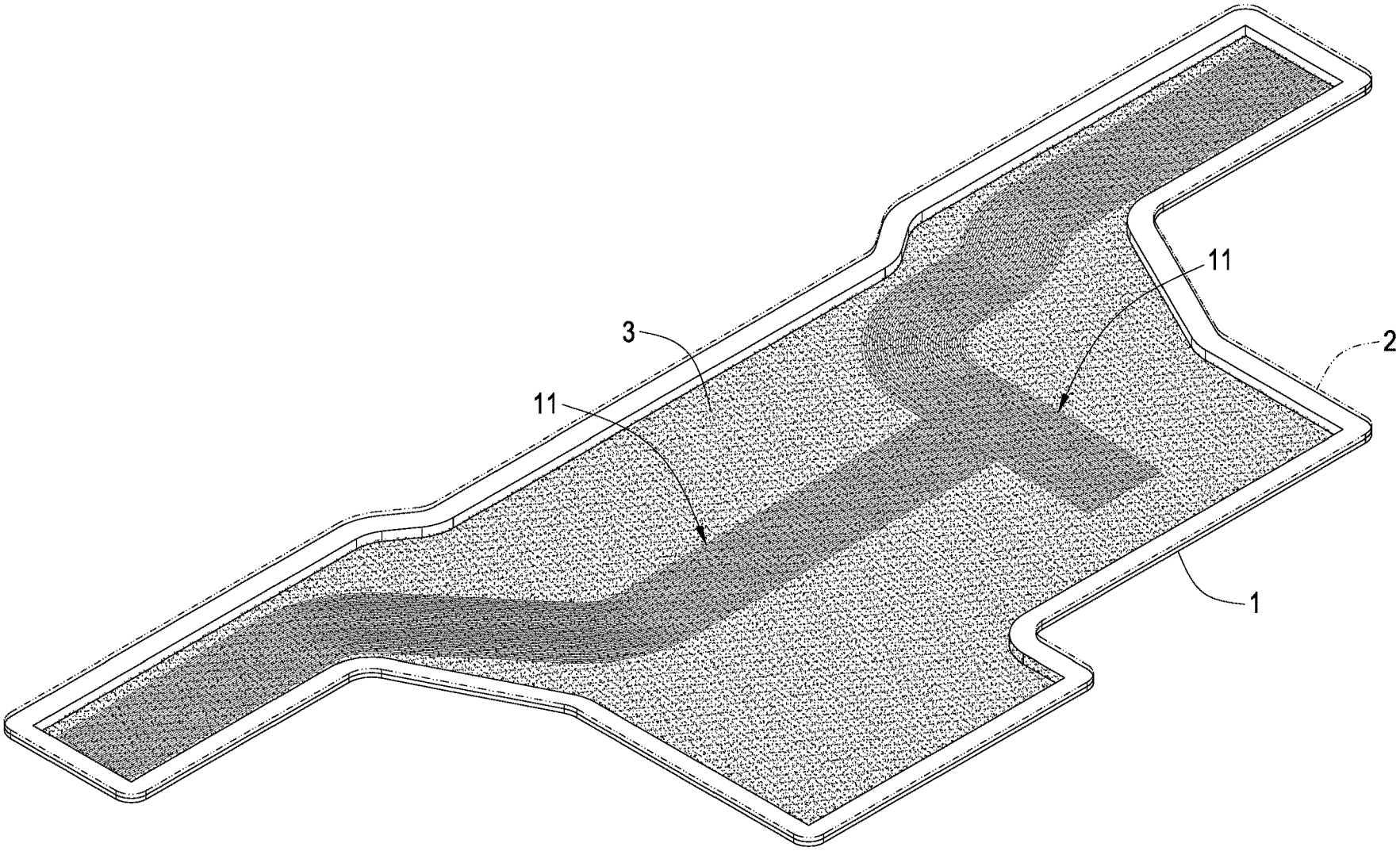
FIG. 1 is a perspective view showing the internal structure of the present disclosure.

With reference to FIG. 1 for the perspective view showing the internal structure of a grooved vapor chamber capillary reflow structure of the present disclosure, the grooved vapor chamber capillary reflow structure includes a first plate 1, a second plate 2 and a capillary tissue 3.

Figure 2:
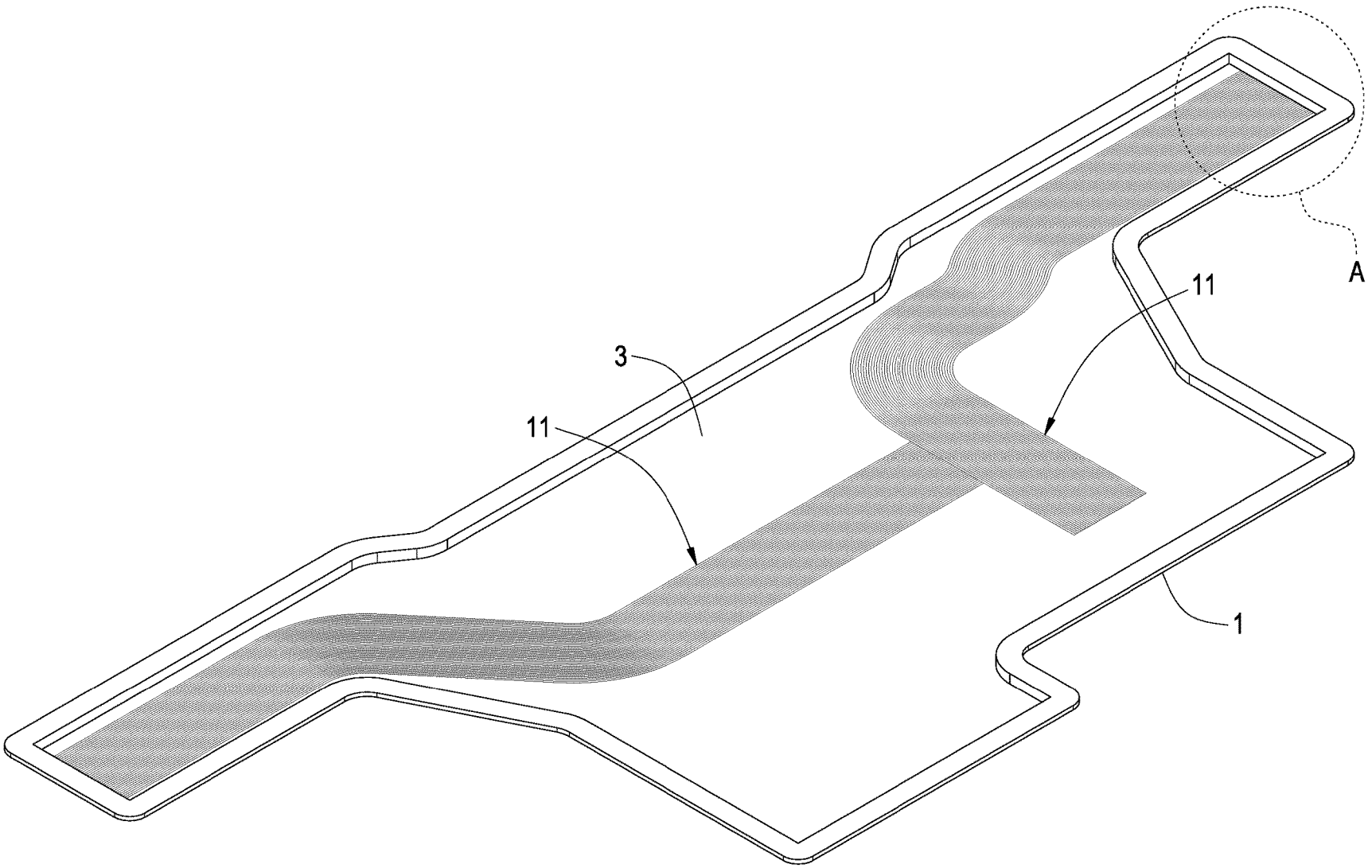
FIG. 2 is a perspective view showing a reflow path defined on a first plate of the present disclosure.

The first plate 1 is made of a material with desirable thermal conductivity such as copper or aluminum. In FIG. 2, the first plate 1 has an inner surface 10, which is formed by recessing any one of the surfaces of the first plate 1. In this embodiment, the first plate 1 is not limited to a simple geometrical shape only, and may be changed to various different shapes to suit the application depending on the actual requirements. Similarly, the shape of the first plate 1 or the second plate 2 disclosed in the present disclosure is not limited.

Figure 5:
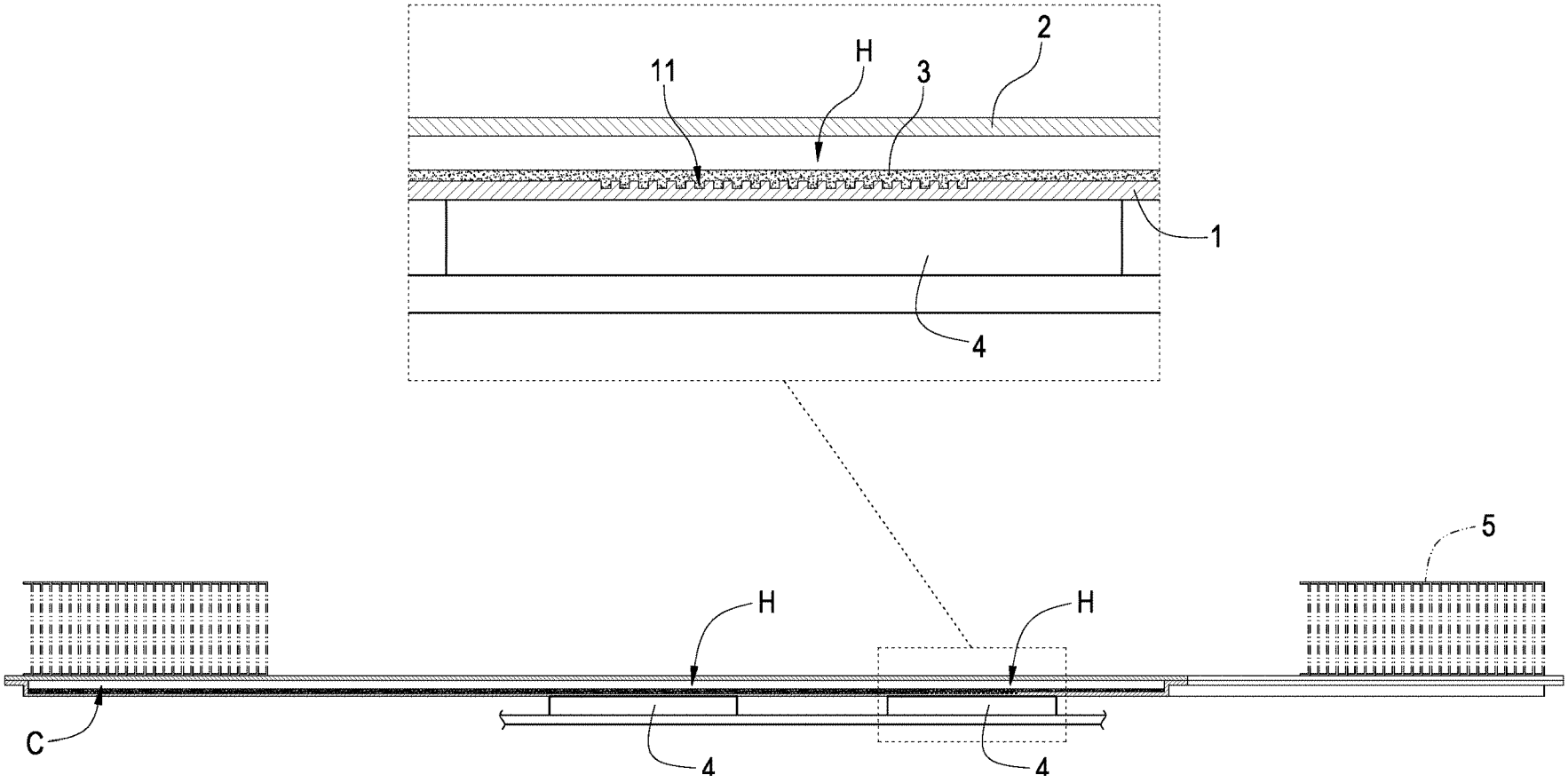
FIG. 5 is a planar view showing another using status of the present disclosure.

In FIG. 1, the second plate 2 is also made of a material with high thermal conductivity such as copper or aluminum. In FIG. 5, the second plate 2 is stacked on the inner surface 10 of the first plate 1 for a sealed connection to form a chamber A between the first plate 1 and the second plate 2, and the chamber A is in a vacuum state and is provided for storing a working fluid (not shown in the figures). In this embodiment, the inner surface 10 of the first plate 1 is in a concave manner, so that when the second plate 2 is stacked toward the inner surface 10 of the first plate 1, the chamber A is formed between the first plate 1 and the second plate 2. In addition, the shape of the second plate 2 is determined by the shape of the first plate 1, but not limited to this shape. If necessary, the shape of the second plate 2 is changed to a shape different to that of the first plate 1.

Figure 4:
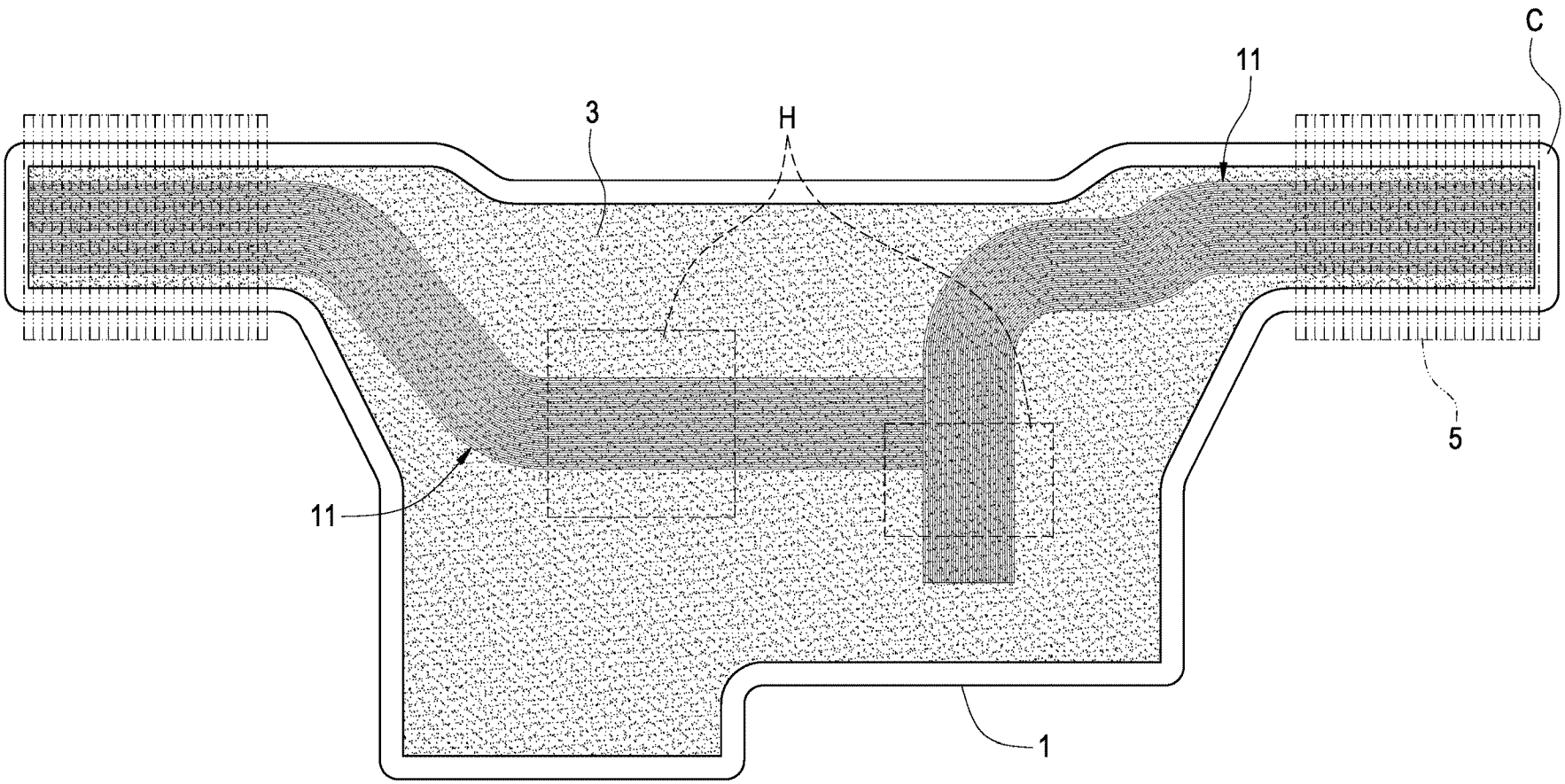
FIG. 4 is a planar view showing a using status of the present disclosure.
Figure 6:
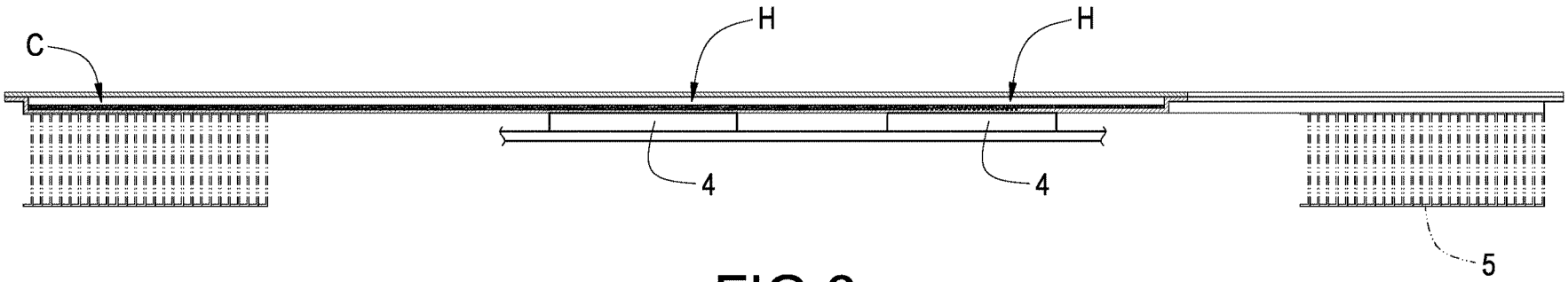
FIG. 6 is a planar view showing a further using status of the present disclosure.

In FIGS. 4 and 5, at least one evaporation area H and at least one condensation area C are defined in the chamber A. The evaporation area His used correspondingly for at least one heat source 4, provided for being aligned with the first plate 1 or the second plate 2, and attached to the heat source 4. In an embodiment of the present disclosure, the first plate 1 is in contact with the heat source 4, or the second plate 2 is in contact with the heat source 4 (not shown in the figures). The condensation area C is arranged away from the evaporation area H, and a fin 5 is added to the condensation area C corresponding to the first plate 1 or the second plate 2 for the purpose of cooling. In the embodiment of the present disclosure as shown in FIG. 5, the fin 5 is installed at a position of the second plate 2 corresponding to the condensation area C, or as shown in FIG. 6, the fin 5 is installed at a position of the first plate 1 corresponding to the condensation area C, or the fin 4 is installed at the positions of both the first plate 1 and the second plate 2 corresponding to the condensation area C (not shown in the figures).

Figure 3:
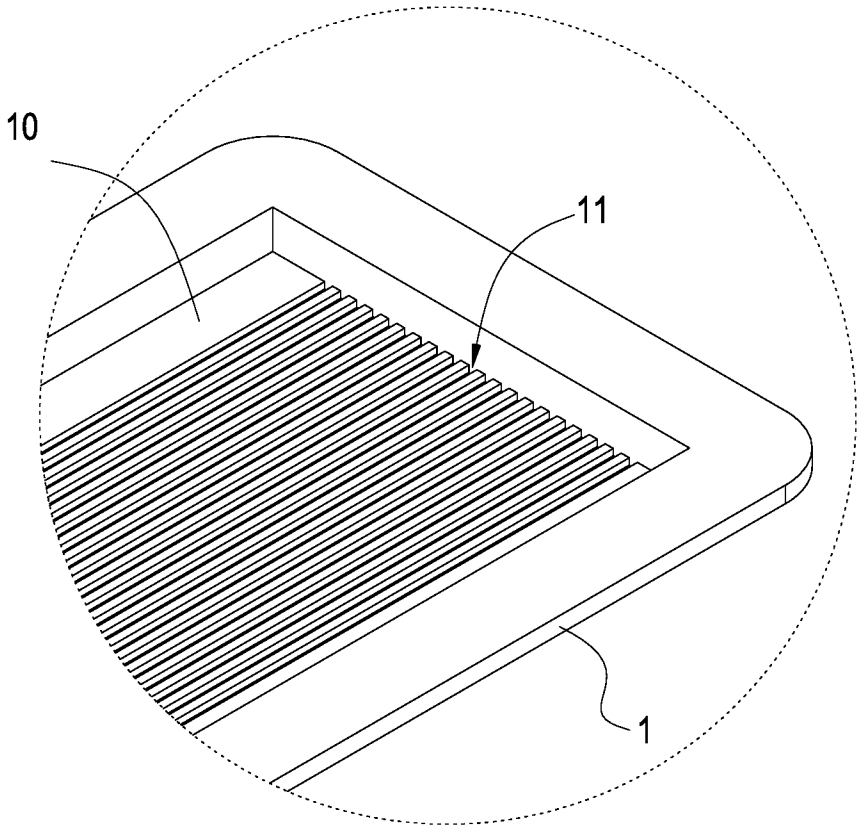
FIG. 3 is an enlarged view of section A of FIG. 2.

With reference to FIGS. 2 to 4 for the present disclosure, the inner surface 10 of the first plate 1 is provided with at least one reflow path 11, the reflow path 11 is formed by a groove, and groove for forming the reflow path 11 extends from the evaporation area H to the condensation area C inside the chamber A. In FIG. 3, the groove is formed by etching. For example, the reflow path 11 is formed on the inner surface 10 of the first plate 1 by etching, so the groove formed by the reflow path 11 is concave downward from the inner surface 10 to form a groove shape. In other words, the top edge of the groove formed by the reflow path 1 is lower than or at the same level with the inner surface 10 (as shown in the blowup part of FIG. 5). In addition, the number of reflow paths 11 may be multiple and the number of reflow paths 11 may also be multiple for the application having a plurality of evaporation areas H and a plurality of condensation areas C, and the reflow paths 11 may be independent, or intersected or connected to one another.

In FIGS. 4 and 5, the capillary tissue 3 is a woven mesh or sintered powder covered on the inner surface 10 of the first plate 1. If the capillary tissue 3 is the woven mesh, it may be a single-layer or multi-layer mesh structure stacked on the inner surface 10 of the first plate 1 for contact, so that the reflow path 11 is covered under the capillary tissue 3. If the capillary tissue 3 is the sintered powder, the powder is put on the inner surface 10 of the first plate 1 and the reflow path 11 before sintering, and the power is adhered and combined with the inner surface 10 and the reflow path 11 after sintering.

Therefore, the grooved vapor chamber capillary reflow structure of the present disclosure is obtained by the aforementioned structural assembly.

In FIG. 4, a flow route is effectively planned for a flow from the evaporation area H to the condensation area C by the reflow path 11 formed by a groove in accordance with the present disclosure and provided for the working fluid to be vaporized and returned into its liquid state, and the working fluid flows along the reflow path 11 from the condensation area C to the evaporation area H more quickly. In the same time, the capillary tissue 3 completely covers the inner surface 10 on the reflow path 11, so that the capillary force of the capillary tissue 3 is larger at the location where it overlaps with the reflow path 11. As a result, the liquid state working fluid accumulated on the capillary tissue 3 is immediately condensed toward the reflow path 11 when it encounters heat, and the working fluid flows directly along the reflow path 11 to the evaporation area H for storage, which is helpful for the application in a sudden heat burst of the heat source 4.

In summation of the description above, the present disclosure invention surely achieves the purpose of use as stated above, overcomes the drawbacks of the related art.

While the present disclosure is illustrated by exemplary embodiments, there may be numerous other embodiments of the present disclosure, a person skilled in the art may make various corresponding changes and variations in accordance with the present disclosure without departing from the spirit of the present disclosure, but these corresponding changes and variations shall fall within the scope of protection of the patents applied for in the present disclosure.

What is claimed is:

1. A grooved vapor chamber capillary reflow structure, comprising:

a first plate, comprising an inner surface;

a second plate, sealed on the inner surface of the first plate to define a chamber therebetween; and a capillary structure, covering the inner surface of the first plate;

wherein, the chamber comprises a first and a second evaporation areas, and a first and a second condensation areas defined therein, a first and a second reflow paths are disposed on the inner surface of the first plate, each of the first and the second reflow paths is defined by a plurality of grooves, and the first and the second reflow paths extend from the first and the second evaporation areas to the first and the second condensation areas in the chamber, respectively;

wherein the first and the second reflow paths are intersected or coupled with one another;

wherein the evaporation area is disposed corresponding to at least one heat source, and the first plate or the second plate is attached to the heat source at a position corresponding to the evaporation area;

wherein the condensation area comprises a fin disposed at a position of the first plate or the second plate corresponding to the condensation area.

2. The grooved vapor chamber capillary reflow structure according to claim 1, wherein the first plate is made of copper or aluminum.

3. The grooved vapor chamber capillary reflow structure according to claim 1, wherein the inner surface of the first plate comprise a concave shape.

4. The grooved vapor chamber capillary reflow structure according to claim 1, wherein the second plate is made of copper or aluminum.

5. The grooved vapor chamber capillary reflow structure according to claim 1, wherein each groove is formed by an etching manner.

6. The grooved vapor chamber capillary reflow structure according to claim 1, wherein each groove is formed concavely downward from the inner surface.

7. The grooved vapor chamber capillary reflow structure according to claim 1, wherein a top edge of each groove is lower than or at a same level with the inner surface.

* * * * *